US010436201B2

(12) United States Patent
Nilangekar et al.

(10) Patent No.: US 10,436,201 B2
(45) Date of Patent: Oct. 8, 2019

(54) SCROLL COMPRESSOR PROVIDED WITH A LUBRICATION SYSTEM

(71) Applicant: Danfoss LLC, Arkadelphia, AR (US)

(72) Inventors: Parimal Nilangekar, Arkadelphia, AR (US); Tapesh Patel, Tallahassee, FL (US); Swapnil Khaire, Knoxville, TN (US); Ye Hang, Tianjin (CN)

(73) Assignee: DANFOSS LLC, Arkadelphia, AR (US)

( * ) Notice: Subject to any disclaimer, the term of this patent is extended or adjusted under 35 U.S.C. 154(b) by 309 days.

(21) Appl. No.: 15/188,852

(22) Filed: Jun. 21, 2016

(65) Prior Publication Data

US 2017/0363085 A1 Dec. 21, 2017

(51) Int. Cl.

| | |
|---|---|
| ***F04C 29/02*** | (2006.01) |
| ***F04C 18/02*** | (2006.01) |
| ***F01C 17/06*** | (2006.01) |

(52) U.S. Cl.

CPC ..... *F04C 29/02* (2013.01); *F04C 18/0215* (2013.01)

(58) Field of Classification Search

CPC .. F04C 18/0215; F04C 29/02; F04C 18/0246; F01C 17/066

USPC ..... 418/55.6, 55.3, 55.1, DIG. 1, 94; 464/102, 104, 105

See application file for complete search history.

(56) References Cited

U.S. PATENT DOCUMENTS

| | | | | |
|---|---|---|---|---|
| 5,716,202 A * | 2/1998 | Koyama | F01C 17/066 | 418/55.3 |
| 6,017,205 A * | 1/2000 | Weatherston | F04C 18/0215 | 184/6 |
| 6,776,593 B1 * | 8/2004 | Cho | F04C 18/0215 | 418/55.3 |
| 9,011,120 B2 * | 4/2015 | Adachi | F01C 17/066 | 418/55.3 |

* cited by examiner

*Primary Examiner* — Deming Wan

(74) *Attorney, Agent, or Firm* — Cantor Colburn LLP

(57) ABSTRACT

A scroll compressor includes a scroll compression unit having a fixed scroll and an orbiting scroll a drive shaft configured to drive the orbiting scroll in an orbital movement, and a support frame including a bearing configured to guide in rotation a guided portion of the drive shaft. The scroll compressor also includes an anti-rotation device including a pair of first engaging elements slidably engaged with a pair of complementary engaging elements on the support frame; and a lubrication system to lubricate at least partially the first engaging elements. The lubrication system includes a lubrication channel and hole on the drive shaft; the hole is fluidly connected to the channel and emerges in an outer wall of the guided portion. The system further includes an oil lubrication passage on the support frame, which includes an oil inlet aperture emerging in a receiving chamber, and an oil outlet aperture configured to supply with oil at least one of the first engaging elements.

15 Claims, 5 Drawing Sheets

SCROLL COMPRESSOR PROVIDED WITH A LUBRICATION SYSTEM

TECHNICAL FIELD

The present disclosure relates to a scroll compressor, and in particular to a scroll refrigeration compressor.

BACKGROUND

A conventional scroll refrigeration compressor includes:

a closed container, a scroll compression unit disposed in the closed container and including:

a fixed scroll including a fixed base plate and a fixed spiral wrap, an orbiting scroll including an orbiting base plate and an orbiting spiral wrap, the fixed spiral wrap and the orbiting spiral wrap forming a plurality of compression chambers, a drive shaft configured to drive the orbiting scroll in an orbital movement, a driving unit coupled to the drive shaft and configured to drive in rotation the drive shaft about a rotation axis, a support frame on which the orbiting base plate is slidably mounted, the support frame including a bearing configured to guide in rotation a guided portion of the drive shaft, an Oldham coupling configured to prevent rotation of the orbiting scroll with respect to the fixed scroll and the support frame, the Oldham coupling including a pair of first engaging elements respectively slidably engaged with a pair of complementary engaging elements provided on the support frame, and a pair of second engaging elements respectively slidably engaged with a pair of complementary engaging elements provided on the fixed scroll, a refrigerant suction part suitable for supplying the scroll compression unit with refrigerant to be compressed, and an oil sump.

Typically, the Oldham coupling is disposed inside the refrigerant flow path. Thus, the engaging elements of the Oldham coupling can be lubricated by the oil droplets contained in the refrigerant.

However, such a lubrication of the engaging elements of the Oldham coupling by means of the refrigerant may be insufficient, notably when the refrigerant has a low oil content, particularly when the refrigerant is a propane refrigerant such as R290 refrigerant, or when the Oldham coupling is disposed outside the refrigerant flow path, which may harm the efficiency and the reliability of the scroll compression unit, and thus of the scroll compressor.

SUMMARY

The present disclosure provides an improved scroll compressor which can overcome the drawbacks encountered in conventional scroll compressors.

The present disclosure further provides a scroll compressor which is reliable.

According to the disclosure such a scroll compressor includes at least:

a scroll compression unit including:

a fixed scroll including a fixed base plate and a fixed spiral wrap, an orbiting scroll including an orbiting base plate and an orbiting spiral wrap, the fixed spiral wrap and the orbiting spiral wrap forming a plurality of compression chambers, a drive shaft including a guided portion, and a driving part configured to drive the orbiting scroll in an orbital movement, a support frame on which the orbiting base plate is slidably mounted, the support frame including a bearing configured to guide in rotation the guided portion of the drive shaft, and a receiving chamber in which the driving part is movably disposed, an anti-rotation device configured to prevent rotation of the orbiting scroll with respect to the fixed scroll and the support frame, the anti-rotation device including at least a pair of first engaging elements respectively slidably engaged with a pair of complementary engaging elements provided on the support frame, an oil sump, a lubrication system configured to lubricate at least partially the first engaging elements of the anti-rotation device with oil supplied from the oil sump, the lubrication system including at least:

a lubrication channel provided on the drive shaft and extending over at least a part of a length of the drive shaft, the lubrication channel being configured to be supplied with oil from the oil sump, and an oil lubrication passage provided on the support frame, the oil lubrication passage including an oil inlet aperture emerging in the receiving chamber and an oil outlet aperture configured to supply with oil at least one of the first engaging elements of the anti-rotation device.

Such a configuration of the lubrication system allows to lubricate the first engaging elements of the Oldham coupling with enough oil, particularly when the scroll compressor is operating at maximal load, without having a high oil circulation rate. Therefore, such a configuration of the lubrication system enables an optimized lubrication of the Oldham coupling, prevents wear of the first engaging elements, and thus improves the reliability and efficiency of the Oldham coupling and of the scroll compression unit, even using R290 refrigerant.

The scroll compressor may also include one or more of the following features, taken alone or in combination.

According to an embodiment of the disclosure, the receiving chamber is fluidly connected to the lubrication channel.

According to an embodiment of the disclosure, the oil outlet aperture of the oil lubrication passage emerges in a respective one of the complementary engaging elements provided on the support frame.

According to an embodiment of the disclosure, the oil lubrication passage extends substantially radially with respect to a longitudinal axis of the drive shaft.

According to an embodiment of the disclosure, each of the first engaging elements is an engaging projection, and each of the complementary engaging elements provided on the support frame is an engaging groove.

According to an embodiment of the disclosure, the anti-rotation device is slidable with respect to the fixed scroll and the support frame along a displacement direction, and the engaging grooves provided on the support frame are offset from each other and extend substantially parallel to the displacement direction.

According to an embodiment of the disclosure, each engaging groove provided on the support frame includes a side wall portion and a bottom wall portion.

According to an embodiment of the disclosure, the oil outlet aperture of the oil lubrication passage emerges in the side wall portion of the respective one of the engaging groove provided on the support frame.

According to an embodiment of the disclosure, the side wall portion of each engaging groove is formed by a side wall portion of a respective engaging slot arranged in the support frame, and the bottom wall portion of each engaging groove is formed by a respective tab secured to the support frame.

According to an embodiment of the disclosure, the width of each tab corresponds substantially to the width of the respective engaging slot.

According to an embodiment of the disclosure, each tab includes an obturating portion forming the bottom wall portion of the respective engaging groove and configured to partially obturate the respective engaging slot, and a mounting portion secured to the support frame.

According to an embodiment of the disclosure, the lubrication system further includes a lubrication hole provided on the drive shaft and fluidly connected to the lubrication channel, the lubrication hole emerging in an outer wall of the guided portion of the drive shaft.

According to an embodiment of the disclosure, the lubrication hole faces the bearing.

According to an embodiment of the disclosure, the lubrication hole extends substantially radially with respect to the longitudinal axis of the drive shaft.

According to an embodiment of the disclosure, the anti-rotation device further includes a pair of second engaging elements respectively slidably engaged with a pair of complementary engaging elements provided on the orbiting scroll.

According to an embodiment of the disclosure, the anti-rotation device includes an annular body, the pair of first engaging elements being provided on a first side of the annular body and the pair of second engaging elements being provided on a second side of the annular body.

According to an embodiment of the disclosure, the anti-rotation device is an Oldham coupling.

According to an embodiment of the disclosure, the anti-rotation device is provided between the orbiting scroll and the support frame.

According to an embodiment of the disclosure, the scroll compressor further includes a driving unit coupled to the drive shaft and configured to drive in rotation the drive shaft about a rotation axis.

According to an embodiment of the disclosure, the scroll compressor further includes a closed container delimiting the oil sump.

According to an embodiment of the disclosure, the oil lubrication passage has a substantially circular cross-section, and has an inner diameter ranging between 2.9 and 3.1 mm.

According to an embodiment of the disclosure, the lubrication system includes two oil lubrication passages provided on the support frame, each oil lubrication passage including an oil inlet aperture emerging in the receiving chamber and an oil outlet aperture configured to supply with oil a respective one of the first engaging elements.

According to an embodiment of the disclosure, the lubrication channel emerges in an end face of the driving part oriented towards the scroll compression unit.

According to an embodiment of the disclosure, the orbiting scroll includes a connecting sleeve part configured to cooperate with the driving part of the drive shaft, the connecting sleeve part being movably disposed in the receiving chamber. Advantageously, the end face of the driving part oriented towards the scroll compression unit faces the orbiting base plate.

According to an embodiment of the disclosure, the driving part of the drive shaft is mounted in the connecting sleeve part.

According to an embodiment of the disclosure, the drive shaft extends across the support frame, and advantageously vertically across the support frame.

According to an embodiment of the disclosure, the support frame includes a support part defining the receiving chamber and on which the orbiting base plate is slidably mounted, and an annular guiding part including the bearing. Advantageously, the annular guiding part extends from the support part.

According to an embodiment of the disclosure, the support part is fixed to the closed container.

According to an embodiment of the disclosure, the driving part of the drive shaft is an eccentric driving part. The driving part may for example be provided on an end portion of the drive shaft oriented towards the scroll compression unit.

According to an embodiment of the disclosure, the support part includes an inner cylindrical surface defining the receiving chamber. Advantageously, the oil lubrication passage emerges in the inner cylindrical surface.

According to an embodiment of the disclosure, the lubrication channel emerges in an end face of the driving part oriented towards the scroll compression unit. According to an embodiment of the disclosure, the lubrication channel includes an oil outlet emerging in the end face of the driving part oriented towards the scroll compression unit.

According to an embodiment of the disclosure, the receiving chamber is fluidly connected to the oil outlet of the lubrication channel.

According to an embodiment of the disclosure, the scroll compressor further includes an oil return channel provided on the support frame, the oil return channel including an oil inlet emerging in the receiving chamber, and an oil outlet fluidly connected to the oil sump and configured to return a part of the oil contained in the receiving chamber towards the oil sump. Advantageously, the oil inlet of the oil return channel emerges in the inner cylindrical surface of the support part.

According to an embodiment of the disclosure, the oil outlet emerges in an outer surface of the support frame.

According to an embodiment of the disclosure, the oil return channel extends substantially radially with respect to the rotational axis of the drive shaft.

According to an embodiment of the disclosure, the oil return channel has a circular cross-section. Advantageously the oil return channel has an inner diameter higher than the inner diameter of each of the lubrication passages.

According to an embodiment of the disclosure, the bottom wall portion of each engaging groove is directly formed by the support frame, i.e. is made in one-piece with the support frame. For example, the bottom wall portion of each engaging groove is formed by casting.

These and other advantages will become apparent upon reading the following description in view of the drawing attached hereto representing, as non-limiting examples, embodiments of a scroll compressor according to the disclosure.

BRIEF DESCRIPTION OF THE DRAWINGS

The following detailed description of one embodiment of the disclosure is better understood when read in conjunction with the appended drawings being understood, however, that the disclosure is not limited to the specific embodiment disclosed.

DETAILED DESCRIPTION OF THE DRAWINGS

Figure 1:
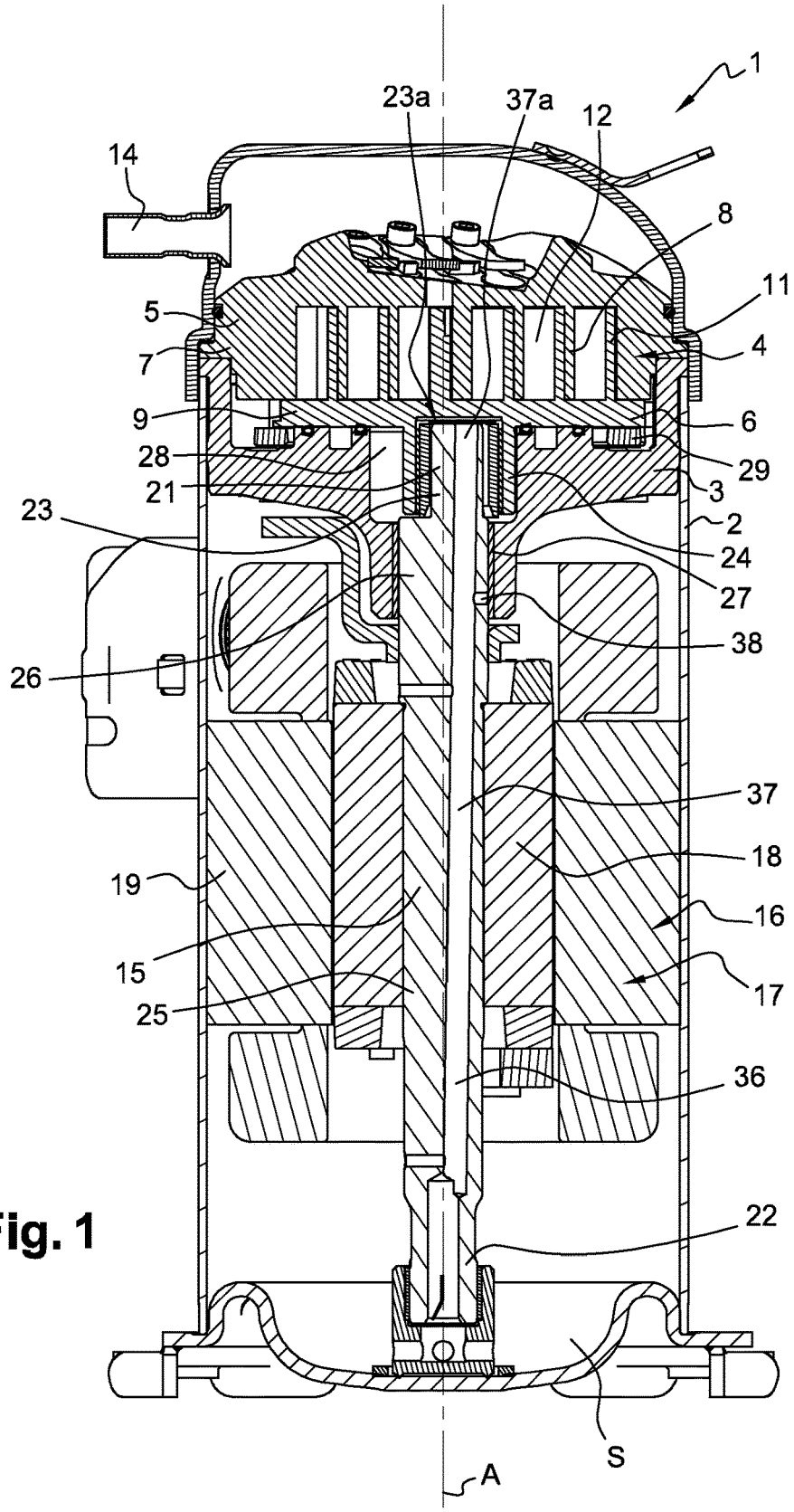
FIG. 1 is a longitudinal section view of a scroll compressor according to the disclosure.
Figure 2:
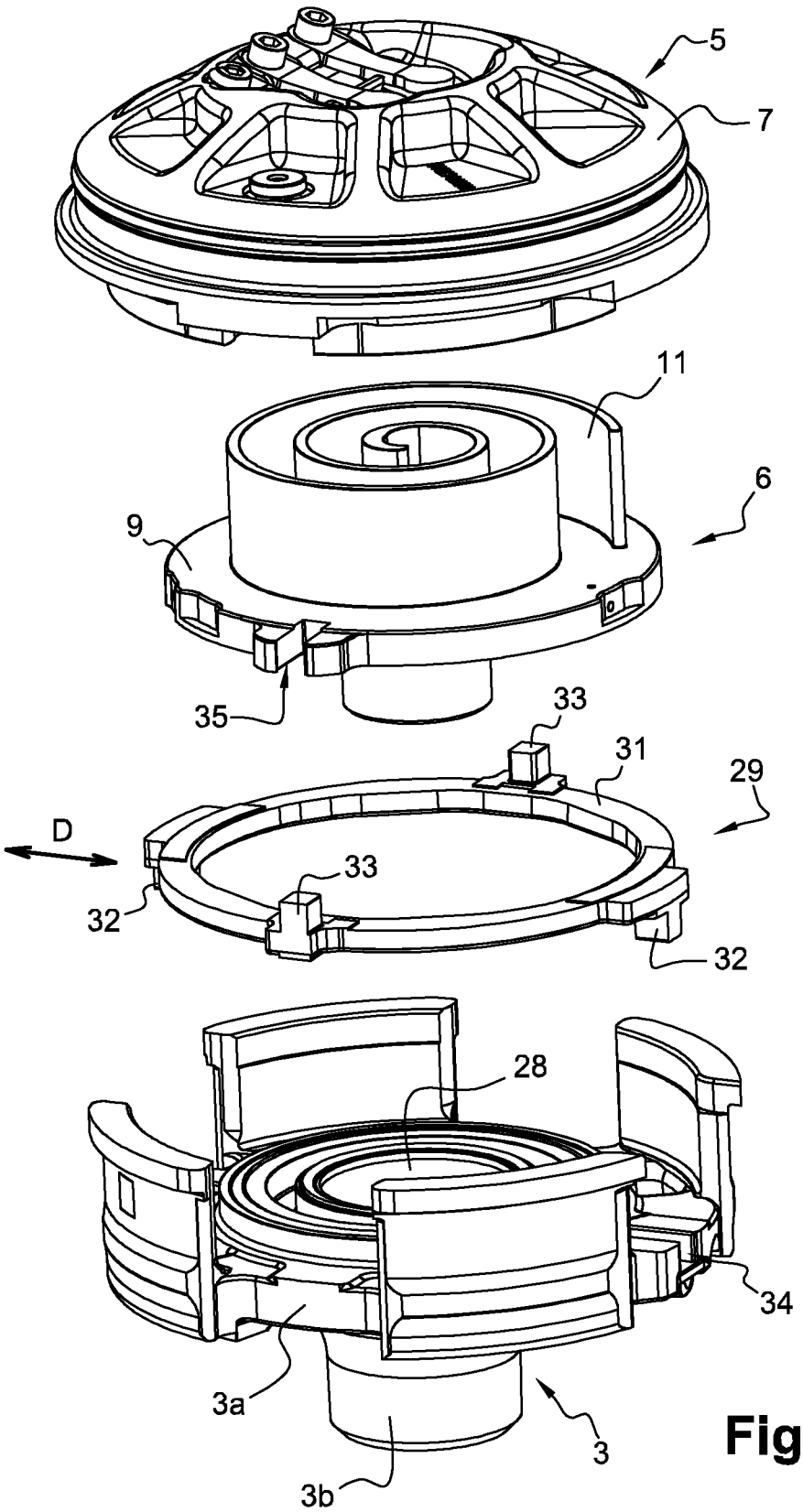
FIGS. 2 and 3 are exploded perspective views of a scroll compression unit, an anti-rotation device and a support frame of the scroll compressor of FIG. 1.
Figure 3:
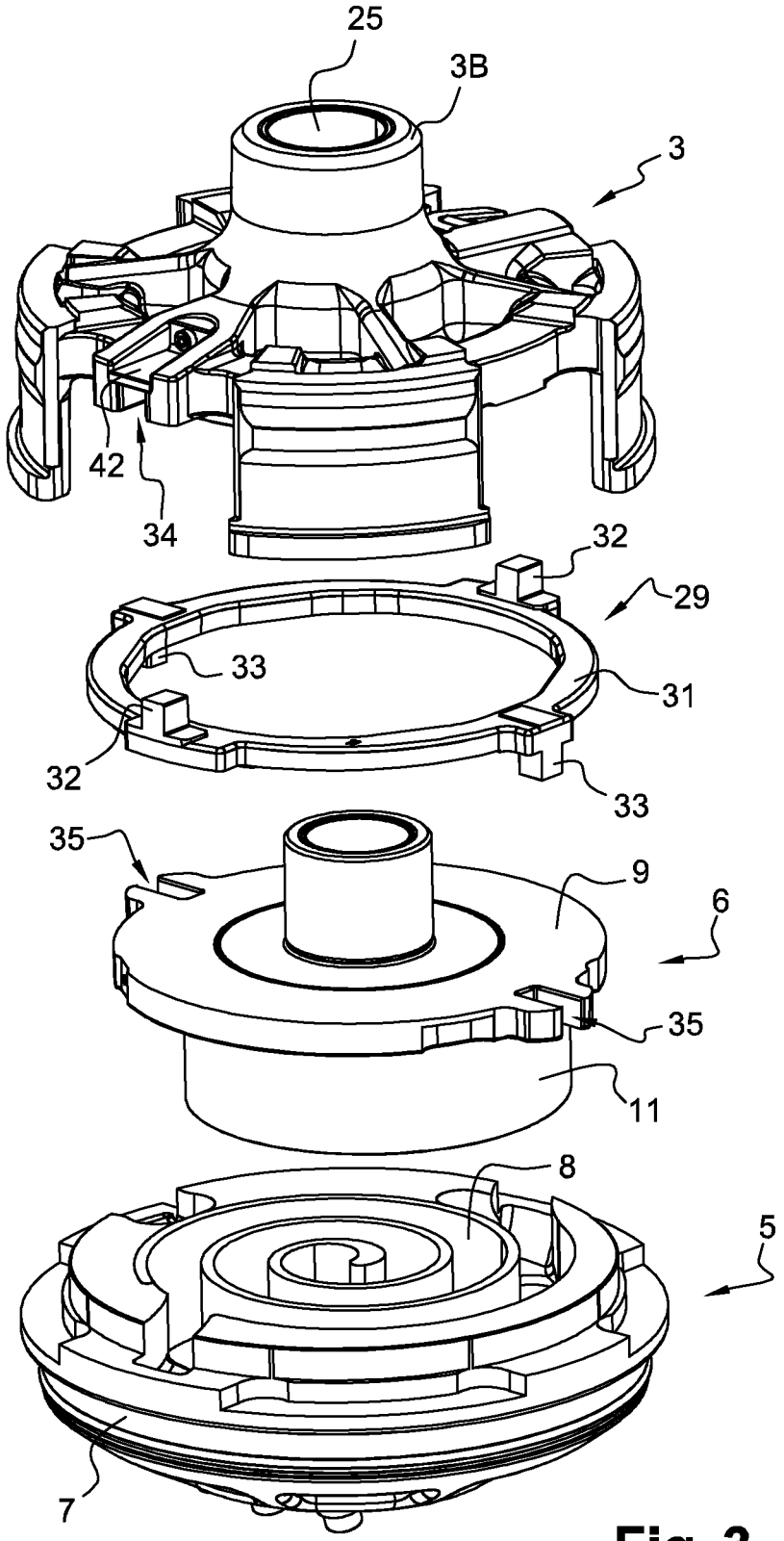
Figure 4:
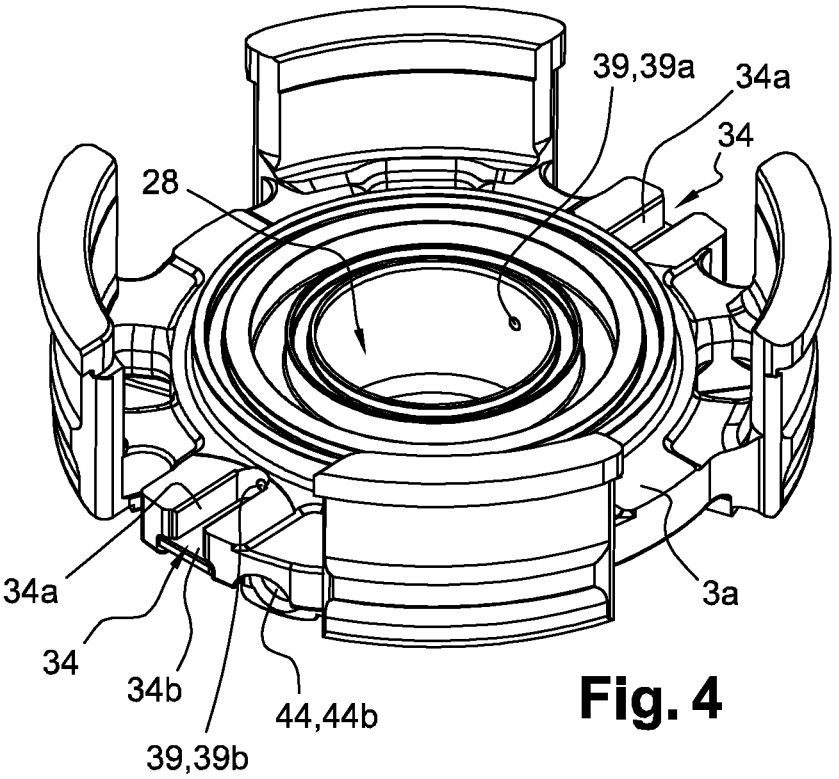
FIGS. 4 and 5 are two top perspective views of the support frame of the scroll compressor of FIG. 1.
Figure 5:
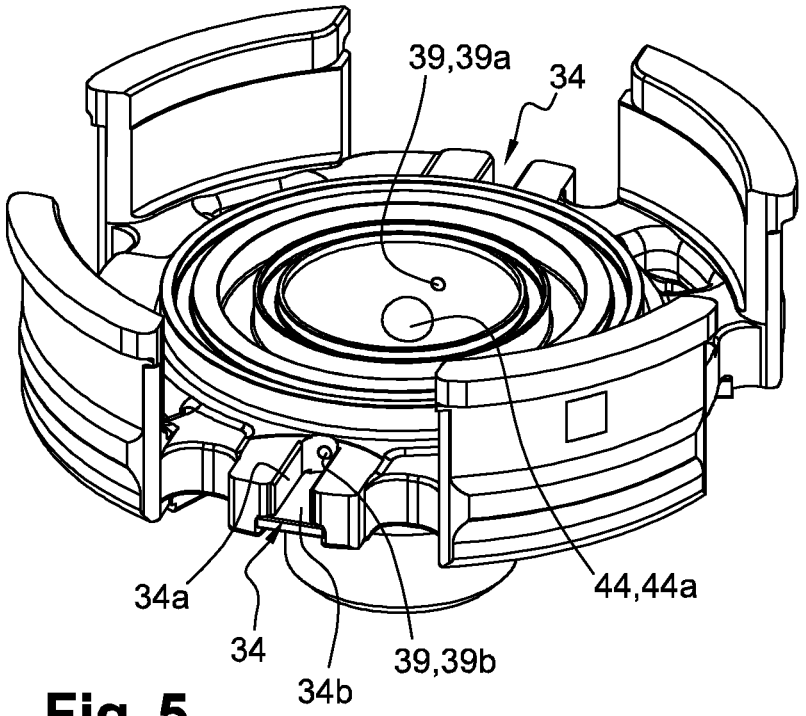

FIG. 1 shows a vertical scroll compressor 1 including a closed container 2. The scroll compressor 1 further includes a support frame 3, also named crankcase, disposed inside and fixed to the closed container 2, and a scroll compression unit 4 disposed inside the closed container 2 and above the support frame 3.

The scroll compression unit 4 includes a fixed scroll 5 which is fixed in relation to the closed container 2, and an orbiting scroll 6 supported by and in slidable contact with an upper face of the support frame 3.

The fixed scroll 5 includes a base plate 7 and a spiral wrap 8 projecting from the base plate 7 towards the orbiting scroll 6, and the orbiting scroll 6 includes a base plate 9, and a spiral wrap 11 projecting from the base plate 9 towards the fixed scroll 5. The spiral wrap 11 of the orbiting scroll 6 meshes with the spiral wrap 8 of the upper fixed scroll 5 to form a plurality of compression chambers 12 between them. Each of the compression chambers 12 has a variable volume which decreases from the outside towards the inside, when the orbiting scroll 6 is driven to orbit relative to the fixed scroll 5.

The scroll compressor 1 also includes a refrigerant suction pipe (not shown on the figures) for supplying the scroll compression unit 4 with refrigerant to be compressed, and a refrigerant discharge pipe 14 for discharging the refrigerant compressed by the scroll compression unit 4 outside the scroll compressor 1.

Furthermore the scroll compressor 1 includes a drive shaft 15 configured to drive the orbiting scroll 6 in an orbital movement, and an driving unit 16 coupled to the drive shaft 15 and configured to drive in rotation the drive shaft 15 about a rotation axis A.

The driving unit 16 includes an electric driving motor 17, which may be a variable-speed electric motor, located below the support frame 3. The electric driving motor 17 has a rotor 18 fitted on the drive shaft 15, and a stator 19 disposed around the rotor 18.

The drive shaft 15 extends vertically across the support frame 3. The drive shaft 15 includes a first end portion 21 oriented towards the scroll compression unit 4, and a second end portion 22 opposite to the first end portion 21 and located below the support frame 3. The first end portion 21 includes an eccentric driving part 23 which is off-centered from the center axis of the drive shaft 15, and which is configured to cooperate with a connecting sleeve part 24 provided on the orbiting scroll 6 so as to cause the latter to be driven in an orbital movement relative to the fixed scroll 5 when the electric driving motor 17 is operated. The drive shaft 15 further includes an intermediate portion 25 located between the first and second end portion 21, 22 and on which is fitted the rotor 18.

The drive shaft 15 also includes a guided portion 26 located between the intermediate portion 25 and the eccentric driving part 23. The support frame 3 includes a bearing 27 configured to guide in rotation the guided portion 26 of the drive shaft 15. The support frame 3 further includes a receiving chamber 28 located above the bearing 27 and in which the connecting sleeve part 24 and the eccentric driving part 23 are movably disposed.

According to the embodiment shown on the figures, the support frame 3 includes a support part 3*a* defining the receiving chamber 28 and on which the orbiting base plate 9 is slidably mounted, and an annular guiding part 3*b* including the bearing 27 and extending from the support part 3*a*. According to an embodiment of the disclosure, the support part 3*a* includes an inner cylindrical surface defining the receiving chamber 28.

The scroll compressor 1 also includes an Oldham coupling 29 which is slidably mounted with respect to the fixed scroll 5 and the support frame 3 along a displacement direction D. The displacement direction D is substantially perpendicular to the rotation axis A of the drive shaft 15. The Oldham coupling 29 undergoes a reciprocating motion along the displacement direction D, and is configured to prevent rotation of the orbiting scroll 6 with respect to the fixed scroll 5 and the support frame 3.

The Oldham coupling 29 includes an annular body 31 disposed between the base plate 9 of the orbiting scroll 6 and the support frame 3. The Oldham coupling 29 further includes a pair of first engaging projections 32 diametrically opposed and provided on a first side of the annular body 31, and a pair of second engaging projections 33 diametrically opposed and provided on a second side of the annular body 31. The first engaging projections 32 of the Oldham coupling 29 are respectively slidably engaged with a pair of complementary engaging grooves 34 provided on the support frame 3, the complementary engaging grooves 34 being offset and extending parallel to the displacement direction D. The second engaging projections 33 of the Oldham coupling 29 are respectively slidably engaged with a pair of complementary engaging grooves 35 provided on the base plate 9 of the orbiting scroll 6, the complementary engaging grooves 35 being offset and extending perpendicular to the displacement D. Particularly, each complementary engaging groove 34 provided on the support frame 3 includes a side wall portion 34*a* and a bottom wall portion 34*b*.

The scroll compressor 1 further comprises a lubrication system 36 configured to lubricate at least partially the first engaging projections 32 of the Oldham coupling 29 with oil supplied from an oil sump S defined by the closed container 2.

The lubrication system 36 includes a lubrication channel 37 provided on the drive shaft 15 and extending over the whole length of the drive shaft 15. The lubrication channel 37 is configured to be supplied with oil from the oil sump S. According to the embodiment shown on the figure, the lubrication channel 37 emerges in an end face 23*a* of the driving part 23 oriented towards the scroll compression unit 4. Particularly, the lubrication channel 37 includes an oil outlet 37*a* emerging in the end face 23*a* of the driving part 23, the receiving chamber 28 being fluidly connected to the oil outlet 37*a* of the lubrication channel 37.

The lubrication system 36 further includes a lubrication hole 38 provided on the drive shaft 15 and fluidly connected to the lubrication channel 37. The lubrication hole 38 emerges in an outer wall of the guided portion 26 of the drive shaft 15, and faces the bearing 27. Advantageously, the lubrication hole 38 extends substantially radially with respect to the rotational axis A of the drive shaft 15.

The lubrication system 36 also includes two oil lubrication passages 39 provided on the support frame 3. Each oil lubrication passage 39 includes an oil inlet aperture 39*a* emerging in the receiving chamber 28, and an oil outlet aperture 39*b* configured to supply with oil a respective one of the first engaging projections 32 of the Oldham coupling 29. Advantageously, the oil outlet aperture 39*b* of each oil lubrication passage 39 emerges in the side wall portion 34*a* of the respective one of the complementary engaging grooves 34 provided on the support frame 3. The oil inlet aperture 39*a* of each oil lubrication passage 39 emerges in the inner cylindrical surface of the support part 3*a*.

According to the embodiment shown on the figures, each oil lubrication passage 39 extends substantially radially with respect to the rotational axis A of the drive shaft 15. Advantageously each oil lubrication passage 39 has a circular cross-section, and has an inner diameter ranging between 2.9 and 3.1 mm, and for example of approximately 3 mm. However, each oil lubrication passage 39 can have a non-circular cross-section. Further, the inner diameter of each oil lubrication passage 39 can also change depending on the oil regulation or oil lubrication needs, and can thus be outside the previously mentioned range.

Figure 6:
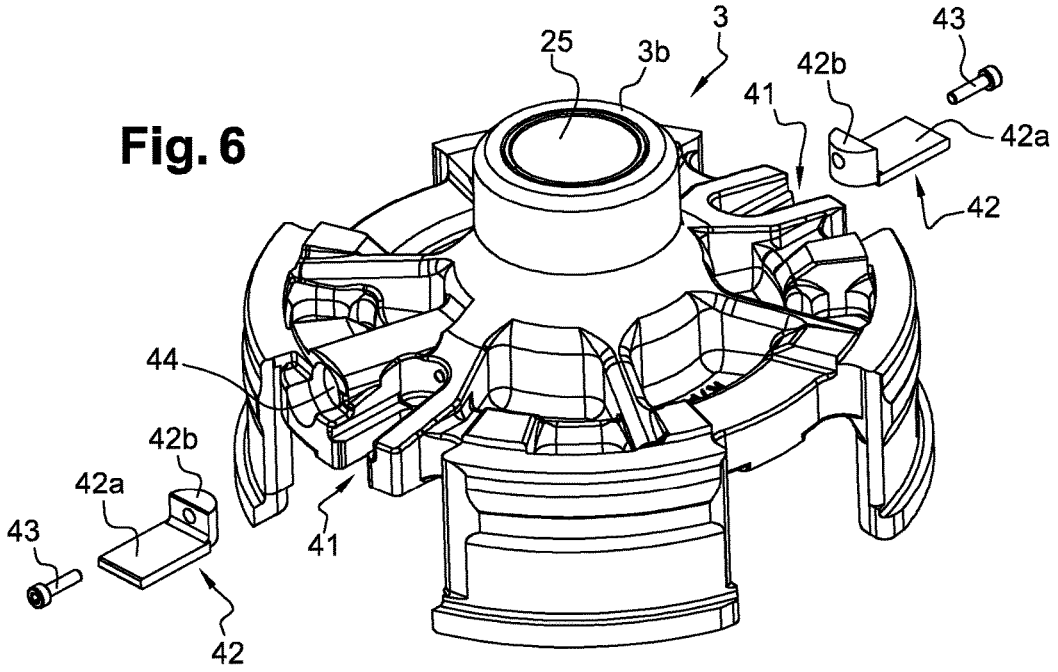
FIG. 6 is an exploded bottom perspective view of the support frame of the scroll compressor of FIG. 1.
Figure 7:
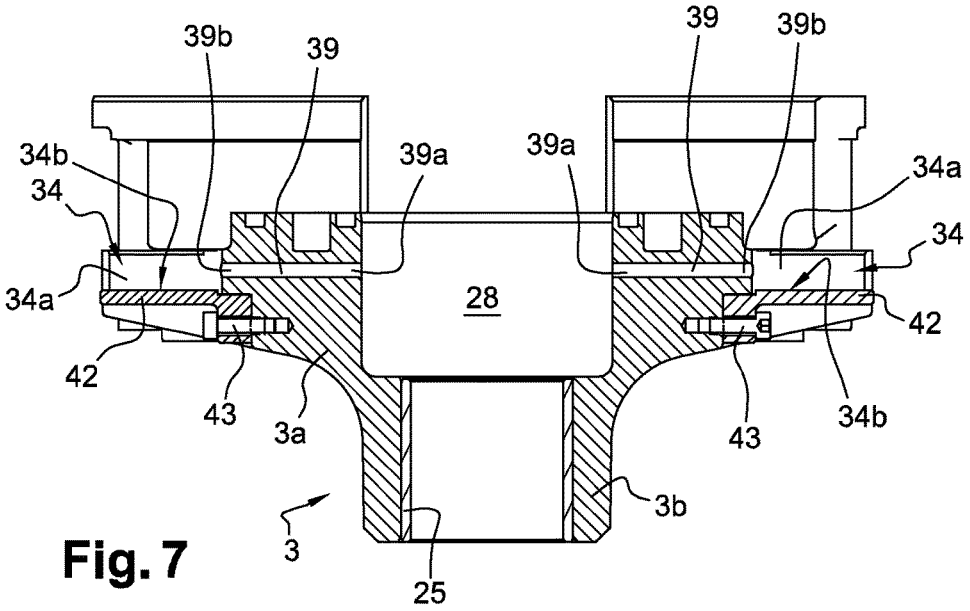
FIG. 7 is a section view of the support frame of the scroll compressor of FIG. 1.

According to the embodiment shown on the figures, the side wall portion 34*a* of each complementary engaging groove 34 is formed by a side wall portion of a respective engaging slot 41 arranged in the support frame 3, and the bottom wall portion 34*b* of each complementary engaging groove 34 is formed by a respective tab 42 (see FIG. 6) secured to the support frame 3.

Advantageously, the dimensions of each tab 42 correspond substantially to the dimensions of the respective engaging slot 41. According to the embodiment shown on the figures, the width of each tab 42 is slightly greater than the width of the respective engaging slot 42, and the length of each tab 42 corresponds substantially to the length of the respective engaging slot 42.

According to the embodiment shown on the figures, each tab 42 includes an obturating portion 42*a* forming the bottom wall portion 34*b* of the respective complementary engaging groove 34 and configured to partially obturate the respective engaging slot 41. Each tab 42 further includes a mounting portion 42*b* secured to the support frame 3, for example with a fixing screw 43. According to the embodiment shown on the figures, the mounting portion 42*b* and the obturating portion 42*a* of each tab 42 extend substantially perpendicularly from each other.

According to the embodiment shown on the figures, the scroll compressor 1 includes an oil return channel 44 provided on the support frame 3. The oil return channel 44 includes an oil inlet 44*a* emerging in the receiving chamber 28, and an oil outlet 44*b* emerging in an outer surface of the support frame 3. The oil outlet 44*b* of the oil return channel 44 is fluidly connected to the oil sump S, and is particularly configured to return a part of the oil contained in the receiving chamber 28 towards the oil sump S. Advantageously, the oil inlet 44*a* of the oil return channel 44 emerges in the inner cylindrical surface of the support part 3*a*.

According to the embodiment shown on the figures, the oil return channel 44 extends substantially radially with respect to the rotational axis A of the drive shaft 15, and has a circular cross-section. Advantageously the oil return channel 44 has an inner diameter higher than the inner diameter of each of the lubrication passages 39.

In operation, oil is sucked from the oil sump S through the lubrication channel 37 and is supplied to the lubrication hole 38. The oil supplied to the oil lubrication hole 38 then flows between the guided portion 26 of the drive shaft 15 and the bearing 27 towards the receiving chamber 28, and is supplied to the two oil lubrication passages 39 via the receiving chamber 28. The oil entering in each oil lubrication passage 39 is finally supplied to the complementary engaging grooves 34 and lubricates the first engaging projections 32 of the Oldham coupling 29.

Of course, the disclosure is not restricted to the embodiment described above by way of non-limiting example, but on the contrary it encompasses all embodiments thereof.

The invention claimed is:

1. A scroll compressor including at least:

a scroll compression unit including:

a fixed scroll including a fixed base plate and a fixed spiral wrap, an orbiting scroll including an orbiting base plate and an orbiting spiral wrap, the fixed spiral wrap and the orbiting spiral wrap forming a plurality of compression chambers, a drive shaft including a guided portion, and a driving part configured to drive the orbiting scroll in an orbital movement, a support frame on which the orbiting base plate is slidably mounted, the support frame including a bearing configured to guide in rotation the guided portion of the drive shaft, and a receiving chamber in which the driving part is movably disposed, an anti-rotation device configured to prevent rotation of the orbiting scroll with respect to the fixed scroll and the support frame, the anti-rotation device including at least a pair of first engaging projections respectively slidably engaged with a pair of complementary engaging grooves provided on the support frame, each of the respective engaging grooves provided on the support frame including a side wall portion and a bottom wall portion, the side wall portion of each of the respective engaging grooves being formed by a side wall portion of a respective engaging slot arranged in the support frame, and the bottom wall portion of each of the respective engaging grooves being formed by a respective tab secured to the support frame, an oil sump, a lubrication system configured to lubricate at least partially the first engaging projections of the anti-rotation device with oil supplied from the oil sump, the lubrication system including at least:

a lubrication channel provided on the drive shaft and extending over at least a part of a length of the drive shaft, the lubrication channel being configured to be supplied with the oil from the oil sump, an oil lubrication passage provided on the support frame, the oil lubrication passage including an oil inlet aperture emerging in the receiving chamber and an oil outlet aperture configured to supply with the oil to at least one of the first engaging projections of the anti-rotation device.

2. The scroll compressor according to claim 1, wherein the oil outlet aperture of the oil lubrication passage in a respective one of the complementary engaging grooves provided on the support frame.

3. The scroll compressor according to claim 1, wherein the oil lubrication passage extends radially with respect to a longitudinal axis of the drive shaft.

4. The scroll compressor according to claim 1, wherein the anti-rotation device is slidable with respect to the fixed scroll and the support frame along a displacement direction, the engaging grooves provided on the support frame being offset from each other and extend parallel to the displacement direction.

5. The scroll compressor according to claim 1, wherein the oil outlet aperture of the oil lubrication passage emerges in the side wall portion of the respective one of the engaging groove provided on the support frame.

6. The scroll compressor according to claim 1, wherein a width of each of the respective tab corresponds to a width of the respective engaging slot.

7. The scroll compressor according to claim 1, wherein each of the respective tab includes an obturating portion forming the bottom wall portion of the respective engaging groove and configured to partially obturate the respective engaging slot, and a mounting portion secured to the support frame.

8. The scroll compressor according to claim 1, wherein the lubrication system further includes a lubrication hole provided on the drive shaft and fluidly connected to the lubrication channel, the lubrication hole emerging in an outer wall of the guided portion of the drive shaft.

9. The scroll compressor according to claim 8, wherein the lubrication hole faces the bearing.

10. The scroll compressor according to claim 1, wherein the anti-rotation device further includes a pair of second engaging elements respectively slidably engaged with a second pair of complementary engaging elements provided on the orbiting scroll.

11. The scroll compressor according to claim 1, wherein the anti-rotation device is an Oldham coupling.

12. The scroll compressor according to claim 1, wherein the oil lubrication passage has a circular cross-section, and has an inner diameter ranging between 2.9 and 3.1 mm.

13. The scroll compressor according to claim 1, wherein the lubrication system includes two oil lubrication passages provided on the support frame, each of the two oil lubrication passages including an oil inlet aperture emerging in the receiving chamber and an oil outlet aperture configured to supply with the oil to a respective one of the first engaging projections.

14. The scroll compressor according to claim 1, wherein the lubrication channel emerges in an end face of the driving part oriented towards the scroll compression unit.

15. A scroll compressor including at least:

a scroll compression unit including:

a fixed scroll including a fixed base plate and a fixed spiral wrap, an orbiting scroll including an orbiting base plate and an orbiting spiral wrap, the fixed spiral wrap and the orbiting spiral wrap forming a plurality of compression chambers, a drive shaft including a guided portion, and a driving part configured to drive the orbiting scroll in an orbital movement, a support frame on which the orbiting base plate is slidably mounted, the support frame including a bearing configured to guide in rotation the guided portion of the drive shaft, and a receiving chamber in which the driving part is movably disposed, an anti-rotation device configured to prevent rotation of the orbiting scroll with respect to the fixed scroll and the support frame, the anti-rotation device including at least a pair of first engaging projections respectively slidably engaged with a pair of complementary engaging grooves provided on the support frame, each of the respective engaging grooves provided on the support frame including a side wall portion and a bottom wall portion, the side wall portion of each of the respective engaging grooves being formed by a side wall portion of a respective engaging slot arranged in the support frame, and the bottom wall portion of each of the respective engaging grooves being formed by a respective tab secured to the support frame, each of the respective tab including an obturating portion forming the bottom wall portion of the respective engaging groove and configured to partially obturate the respective engaging slot, and a mounting portion secured to the support frame, an oil sump, a lubrication system configured to lubricate at least partially the first engaging projections of the anti-rotation device with oil supplied from the oil sump, the lubrication system including at least:

a lubrication channel provided on the drive shaft and extending over at least a part of a length of the drive shaft, the lubrication channel being configured to be supplied with the oil from the oil sump, an oil lubrication passage provided on the support frame, the oil lubrication passage including an oil inlet aperture emerging in the receiving chamber and an oil outlet aperture configured to supply with the oil to at least one of the first engaging projections of the anti-rotation device.

* * * * *